US007102609B2

(12) United States Patent
Saitou et al.

(10) Patent No.: US 7,102,609 B2
(45) Date of Patent: Sep. 5, 2006

(54) LIQUID CRYSTAL DISPLAY

(75) Inventors: Kazunari Saitou, Mobara (JP); Shigeru Itou, Mobara (JP); Yukihide Ode, Mobara (JP); Youzou Nakayasu, Mobara (JP); Shinji Yasukawa, Shirako (JP)

(73) Assignees: Hitachi, Ltd., Tokyo (JP); Hitachi Device Engineering Co. Ltd., Chiba-ken (JP)

( * ) Notice: Subject to any disclaimer, the term of this patent is extended or adjusted under 35 U.S.C. 154(b) by 451 days.

(21) Appl. No.: 10/125,363

(22) Filed: Apr. 19, 2002

(65) Prior Publication Data

US 2002/0180684 A1 Dec. 5, 2002

(30) Foreign Application Priority Data

Apr. 26, 2001 (JP) ..... 2001-128620

(51) Int. Cl.
*G09G 3/36* (2006.01)

(52) U.S. Cl. ..... 345/98; 345/204

(58) Field of Classification Search ..... 345/98, 345/89, 87, 88, 90, 91, 92, 93, 94, 95, 96, 345/97, 204, 205
See application file for complete search history.

(56) References Cited

U.S. PATENT DOCUMENTS

| | | | | |
|---|---|---|---|---|
| 6,127,995 | A * | 10/2000 | Furuhashi et al. | 345/96 |
| 6,335,718 | B1 | 1/2002 | Hong et al. | |
| 6,456,271 | B1 | 9/2002 | Tamai et al. | |
| 2001/0054997 | A1 * | 12/2001 | Fujioka et al. | 345/87 |

FOREIGN PATENT DOCUMENTS

| | | |
|---|---|---|
| JP | 2000-242240 | 2/1999 |
| JP | 2000-207077 | 6/1999 |

* cited by examiner

*Primary Examiner*—Richard Hjerpe
*Assistant Examiner*—Jean Lesperance
(74) *Attorney, Agent, or Firm*—Reed Smith LLP; Stanley P. Fisher, Esq.; Juan Carlos A. Marquez, Esq.

(57) ABSTRACT

The present invention realizes a liquid crystal display which mounts driving circuits of low power consumption on a substrate on which a display part is mounted. The driving circuits which supply gray scale voltages to pixels are mounted on a liquid crystal display panel. Display data is transferred between the driving circuits using wiring formed on the liquid crystal display panel, the display data is transferred in the inside of the driving circuits through inner data bus lines, and a data inversion calculation which inverts values of the display data is performed in the inside of the driving circuits for achieving the low power consumption.

3 Claims, 12 Drawing Sheets

LIQUID CRYSTAL DISPLAY

BACKGROUND OF THE INVENTION

The present invention relates to a liquid crystal display, and more particularly to a liquid crystal display which enables the saving of power by adopting a novel signal transmission method by optimizing wiring constitution for supplying driving signals to driver ICs mounted in a flip-chip method.

A liquid crystal display of a STN (Super Twisted Nematic) method or a TFT (Thin Film Transistor) method has been popularly used as displays of notebook type personal computers and the like. Each liquid crystal display includes a liquid crystal display panel and driving circuits for driving the liquid crystal display panel.

Among such liquid crystal displays, there has been known a so-called flip-chip method (FCA) liquid crystal display which mounts silicon chips on a transparent insulation substrate forming a liquid crystal display panel as described in U.S. Pat. No. 5,739,887 (Japanese Laid-open Patent Publication 122806), for example. The silicon chips are provided with connection terminals (bumps) and are electrically connected with electrodes formed on the transparent insulation substrate. Further, the silicon chips are provided with driving circuits and these driving circuits input control signals, a power supply voltage and the like through the electrodes on the transparent insulation substrate and output signals for driving the liquid crystal display panel to the electrodes on the transparent insulation substrate.

Japanese Laid-open Patent Publication 13724/1994 proposes a liquid crystal display which uses wiring formed on a substrate of a liquid crystal display panel for mutual connection between silicon chips (a sequential serial supply method, a bucket relay method). (Hereinafter referred to as "data transfer method").

As one of signals transmitted through wiring among silicon chips, display data is referred to. The display data is data for displaying images on the liquid crystal display panel and is transmitted to a driving circuit as digital signals. When the gray scale of the liquid crystal display are increased in number, the number of bits of the display data is also increased and the number of wiring is also increased. The wiring formed on the transparent insulation substrate have the wiring resistance and the parasitic capacitance so that when the display data is frequently changed, there arises a problem that the power consumption is increased. Further, recently, it has become no more possible to ignore the power consumption derived from the wiring in the inside of the silicon chips. Further, when the number of gray scales is increased and the number of wiring is also increased, the power consumption is increased correspondingly so that the problems becomes outstanding.

SUMMARY OF THE INVENTION

The present invention has been made to solve the above-mentioned problems of the related art and it is an object of the present invention to provide a technique which can reduce power consumed by wiring among driving circuits in a liquid crystal display.

The above-mentioned and other objects and novel features of the present invention will become more apparent in conjunction with the description of this specification and attached drawings.

To briefly explain the summary of typical inventions among inventions disclosed by the present application, they are as follows.

That is, according to the present invention, a liquid crystal display includes a liquid crystal display panel and driving circuits which supply driving signals to the liquid crystal display panel, the driving circuits are mounted on the liquid crystal display panel, the transmission of signals between the driving circuits is performed based on a data transfer method which uses wiring formed on the liquid crystal display panel, data bus lines disposed in the inside of the driving circuits are configured as data bus lines which are separated into data bus lines for inner circuits and data bus lines for a transfer bus to next-stage drivers, the separation of the data bus is performed after processing by an input latch circuit part, and a circuit having a standby function is added to the inner data bus lines whereby the change of the state of the data bus lines for inner circuits can be reduced.

Further, according to the present invention, a liquid crystal display includes a liquid crystal display panel and driving circuits which supply driving signals to the liquid crystal display panel, the driving circuits are mounted on the liquid crystal display panel, the transmission of signals between the driving circuits is performed based on a data transfer method which uses wiring formed on the liquid crystal display panel, the liquid crystal display is configured to transfer display data using data bus lines disposed in the inside of the driving circuits, and an inversion calculation circuit which inverts the display data to reduce the change of the state of the data bus lines is provided to wiring which follows the data bus lines.

The low power consumption of the liquid crystal display can be realized by the above-mentioned constitution.

DESCRIPTION OF THE PREFERRED EMBODIMENTS

Embodiments of the present invention are explained in detail in conjunction with drawings hereinafter.

In all drawings for explaining the embodiments, parts having identical functions are indicated by same symbols and their repeated explanation is omitted.

Figure 1:
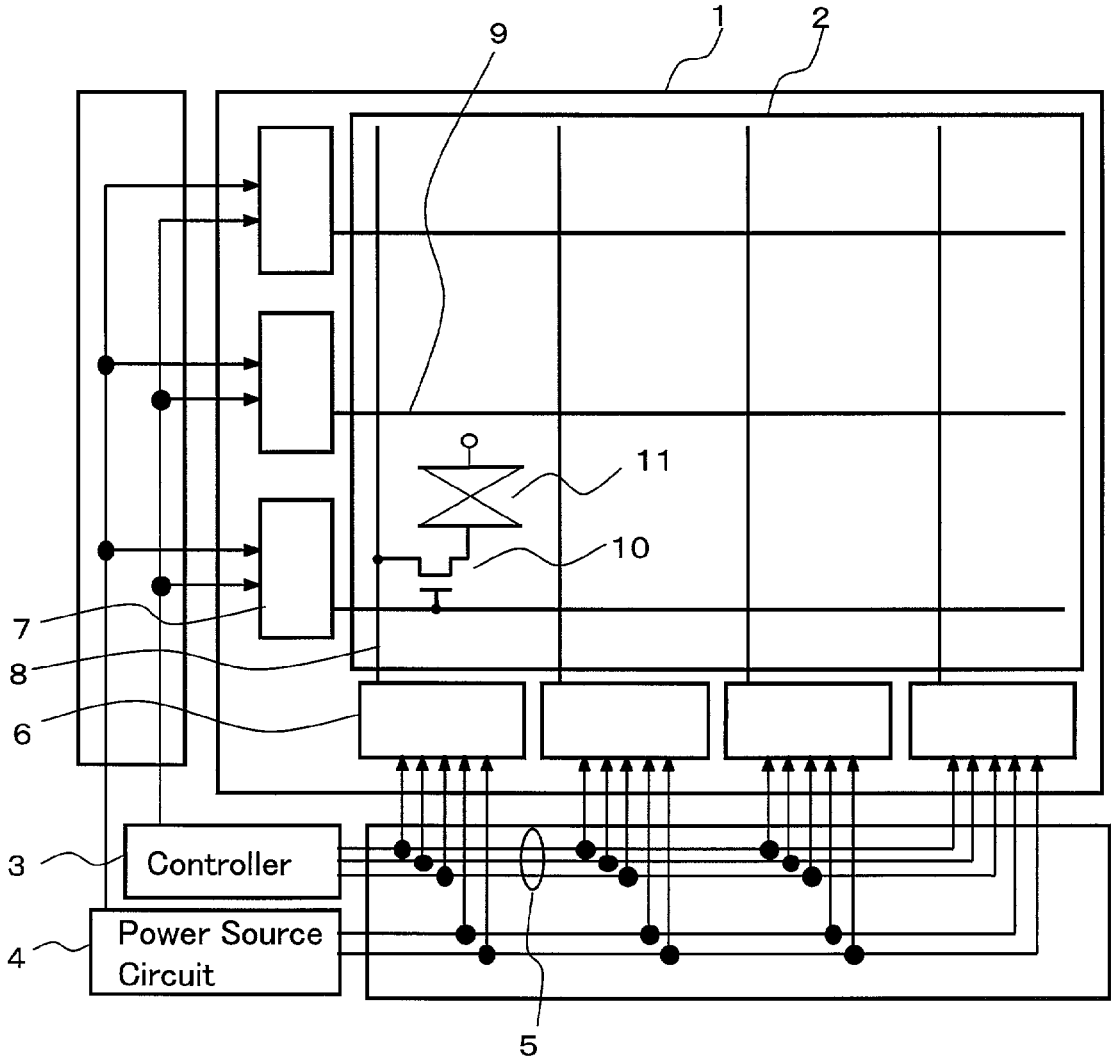
FIG. 1 is a block diagram showing a schematic constitution of a liquid crystal display according to an embodiment of the present invention.

FIG. 1 is a block diagram showing a schematic constitution of a liquid crystal display of an embodiment of the present invention.

In the drawing, numeral 1 indicates a liquid crystal display panel and numeral 2 indicates a display part. Images are displayed on the display part 2 in accordance with display data.

In the drawing, numeral 3 indicates a controller. Display data, control signals and the like are inputted to the controller 3 from the outside (computer or the like). Upon receiving the display data, the control signals and the like from the outside, the controller 3 supplies the display data, various types of clock signals and various types of control signals to the liquid crystal display panel 1. Numeral 4 indicates a power source circuit. The power source circuit 4 generates various types of driving voltages for driving the liquid crystal display panel 1.

Data bus lines 5 are connected to the controller 3. The controller 3 outputs the display data to the data bus lines 5. Further, the controller 3 converts the inputted control signals from the outside and outputs signals for controlling the liquid crystal display panel 1. As the control signals which the controller 3 outputs, timing signals such as a clock signal which allows the source driver 6 to fetch the display data, a clock signal which serves to change over an output from the source driver 6 to the liquid crystal display panel 1, and a gate clock signal which serves to output a frame start command signal and a sequential scanning signal for driving the gate driver 7 are named.

Further, the power source circuit 4 generates and outputs a positive-electrode gray scale voltage, a negative-electrode gray scale voltage, a counter electrode voltage, a scanning signal voltage and the like.

The display data which is outputted from the controller 3 is transferred (hereinafter, also referred to as "transmitted") to the source drivers 6 through the data bus lines 5. The display data is constituted of digital data and the number of data bus lines 5 is determined corresponding to a transferred data quantity. For example, when the transferred data is the data of 6 bits, the number of data bus lines 5 becomes six. Here, the liquid crystal display panel 1 has pixels of red (R), green (G) and blue (B) for performing a color display and respective display data of red (R), green (G) and blue (B) are transferred as one set. Accordingly, when respective display data of red (R), green (G) and blue (B) are transferred as one set, 18 data bus lines in total are used.

The controller 3 outputs the data for one pixel in a unit time to the data bus lines 5. Further, the controller 3 outputs the display data sequentially onto the data bus lines 5. The source drivers 6 fetch data to be displayed from the display data outputted sequentially. Timing that the source driver 6 fetches the display data follows the clock signal. The method for outputting the display data to the data bus lines 5 from the controller 3 and fetching the data to the source driver is explained later.

Along a periphery of the display part 2, the source drivers 6 (driving circuits) are arranged in the lateral direction (X direction). Output terminals of these source drivers 6 are connected to video signal lines 8 of the liquid crystal display panel 1. The video signal lines 8 are extended in the Y direction in the drawing and are connected to drain electrodes of thin film transistors 10. Further, the video signal lines 8 are arranged in a plural number in parallel in the X direction in the drawing. The source drivers 6 fetch the display data from the data bus lines 5 and output the gray scale voltages to the video signal lines 8 in accordance with the display data. The voltage (gray scale voltage) for driving liquid crystal are supplied to the thin film transistors 10 through the video signal lines 8.

Here, although the naming of the "source" and "drain" may be inverted depending on the bias relationship, the lines which are connected to the video signal lines 8 are referred to as "drain".

The gate drivers (scanning circuits) 7 are arranged in the longitudinal direction along a periphery of the display part 2. Output terminals of the gate drivers 7 are connected to scanning signal lines 9 of the liquid crystal display panel 1. The scanning signal lines 9 are extended in the X direction in the drawing and are connected to gate electrodes of the thin film transistors 10. Further, the scanning signal lines 9 are arranged in a plural number in parallel in the Y direction in the drawing. The gate drivers 7 sequentially supplies scanning voltages of high level to the scanning signal lines 9 every 1 horizontal scanning period based on a frame starting command signal and a shift clock supplied from the controller 3. The thin film transistors 10 are subjected to an ON-OFF control in response to the scanning voltages supplied to the gate electrodes.

The display part 2 of the liquid crystal display panel 1 includes pixel portions 11 which are arranged in a matrix array. However, to simplify the drawing, only one pixel portion 11 is shown in FIG. 1. Each pixel portion 11 includes the thin film transistor 10 and a pixel electrode. Each pixel portion 11 is arranged in a crossing region of two neighboring video signal lines 8 and two neighboring scanning signal lines 9 (region surrounded by four signal lines).

As mentioned previously, the scanning signals are outputted to the scanning signal lines 9 from the gate drivers 7. The thin film transistors 10 are turned on and off in response to these scanning signals. Gray scale voltages are supplied to the video signal lines 8 and the gray scale voltages are supplied to the pixel electrodes from the video signal lines 8 when the thin film transistors 10 are turned on. Counter electrodes (common electrodes) are arranged to face the pixel electrodes in an opposed manner and a liquid crystal layer (not shown in the drawing) is formed between the pixel electrodes and the counter electrodes. Here, the circuit diagram shown in FIG. 1 is described such that a liquid crystal capacitance is equivalently connected between the pixel electrode and the counter electrode.

The orientation of the liquid crystal layer is changed by applying voltages between the pixel electrodes and the counter electrodes. The liquid crystal display panel performs the display by making use of a phenomenon that the light transmissivity is changed in response to the change of the orientation of the liquid crystal layer. An image displayed by the liquid crystal display panel 1 is constituted of pixels. The gray scales of respective pixels which constitute the image follow voltages supplied to the pixel electrodes. The source drivers 6 receive the gray scales to be displayed as display data and output corresponding gray scale voltages. Accordingly, corresponding to the increase of the number of gray scales which the liquid crystal display panel 1 displays, a data quantity of the display data and the number of data bus lines 5 are also increased.

It has been known that when the direct voltage is applied to the liquid crystal for a long time, the liquid crystal is deteriorated. To prevent the deterioration of the liquid crystal, the alternation driving which periodically inverts polarity of the voltage applied to the liquid crystal layer is performed. In the alternation driving, signal voltages of positive polarity and negative polarity are applied to the pixel electrodes with respect to the counter electrodes. Accordingly, the power source circuit 4 includes a positive gray-scale voltage generation circuit and negative gray-scale voltage generation circuit. In response to the alternation signals, the source drivers 6 select the gray scale voltages of positive polarity and negative polarity even when the display data is the same.

Figure 2:
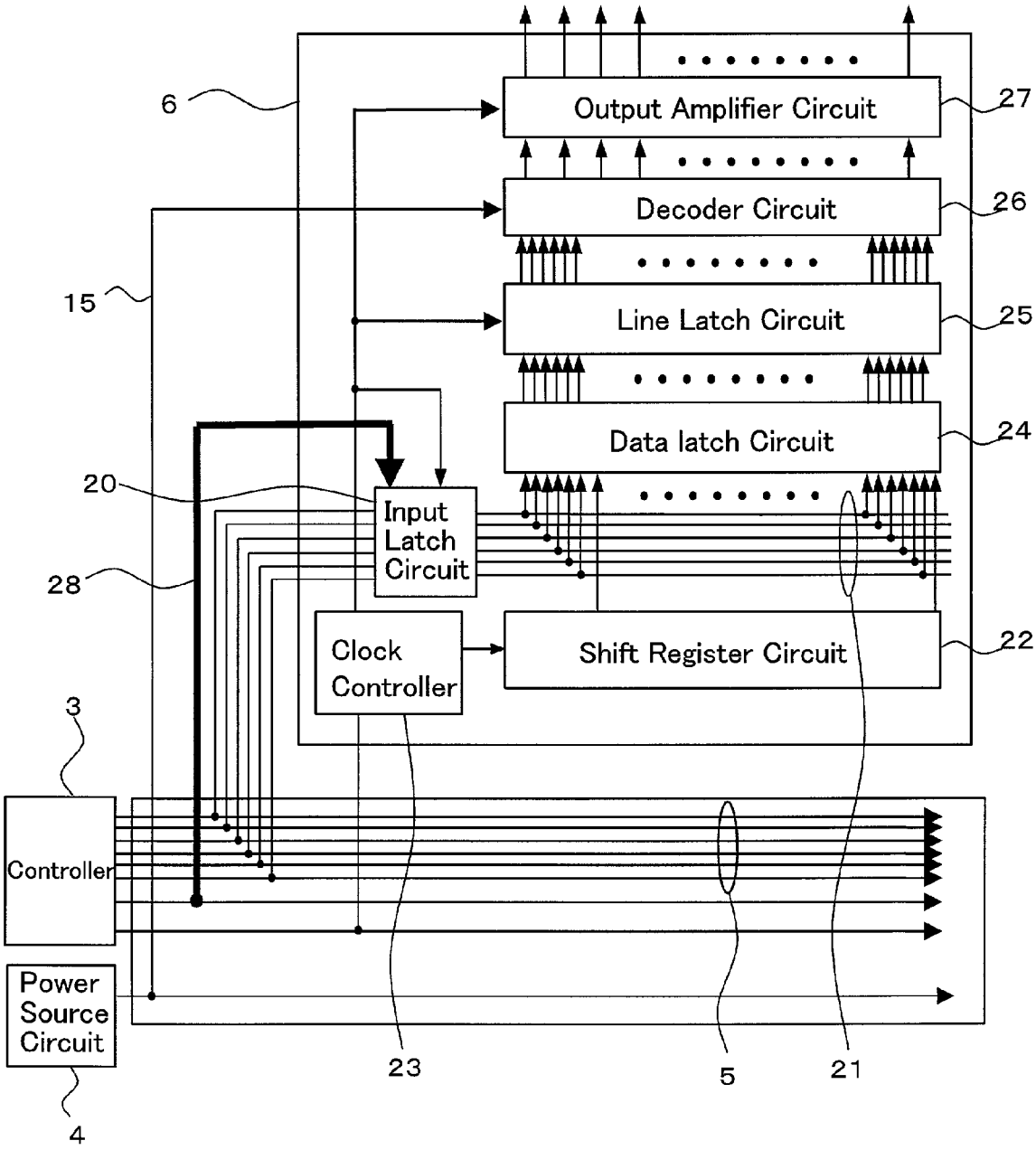
FIG. 2 is a schematic block diagram showing a source driver of the liquid crystal display according to the embodiment of the present invention.

FIG. 2 shows a schematic block diagram of the inside of the source driver 6. The display data outputted from the controller 3 is inputted to an input latch circuit 20 through a data bus lines 5. Inner data bus lines 21 are connected to the input latch circuit 20. In the input latch circuit 20, the display data is synchronized with a clock signal which a clock controller 23 outputs and the synchronized display data is outputted to the inner data bus lines 21. The clock signal from the clock controller 23 is also inputted to a shift register circuit 22 and the shift register circuit 22 sequentially outputs a timing signal in accordance with the clock signal.

When the timing signal is inputted into a data latch circuit 24, the data latch circuit 24 fetches the display data on the inner data bus lines 21. In a state that the display data is fetched in the whole data latch circuits 24, the display data of the data latch circuit 24 is fetched to a line latch circuit 25. The line latch circuit 25 outputs the display data to a decoder circuit 26 and the decoder circuit 26 selects gray scale voltages in accordance with the display data and inputs the selected gray scale voltages to an output amplifier circuit 27. Further, the output amplifier circuit 27 performs the current amplification of the gray scale voltages and outputs the gray scale voltages to the liquid crystal display panel 1. The gray scale voltages are supplied to the decoder circuit 26 through a gray scale voltage line 15. Although wiring which supplies the power source voltage to respective circuits is omitted in FIG. 2, required voltages are supplied to respective circuits.

Although the display data outputted from the controller 3 is inputted into the source driver 6 through the data bus lines 5, when the number of data bus lines 5 is increased, the power consumed by the data bus lines 5 cannot be ignored. That is, the data bus lines 5 has a capacitance component and a resistance component and hence, when the value of data is changed, charging/discharging is generated with respect to the load of wiring so that the power is consumed.

To suppress the power consumption in the data bus lines 5, a method which transfers the display data while preventing the change of the value of display data as much as possible is considered. Numeral 28 indicates a data inversion signal line. The data inversion signal line 28 is connected to the input latch circuit 20. A data inversion signal performs a control whether the value of display data inputted to the input latch circuit 20 is outputted after being inverted or without being inverted. Since the display data is formed of digital signals, the value of signal on the data bus lines 5 is 1 (high level) or 0 (low level). That is, the inversion of the value of display data in response to the data inversion signal means that 0 is outputted when the value of display data which is inputted to the input latch circuit 20 is 1 and 1 is outputted when the inputted value of the display data is 0.

Table 1 shows a relationship between the value of display data on the data bus lines 5 and the data inversion signal provided that the display data is inverted when the data inversion signal set to 1. As shown in Table 1, the calculation of the display data and the data inversion signal becomes the exclusive OR.

The method for utilizing the data inversion signal is explained hereinafter. First of all, as a most effective case, considered is a case in which the first display data on the data bus lines 5 is (000000) and the second display data is (111111). Unless the data inversion signal is used, in a state that the value (000000) is outputted onto the data bus lines 5 as the first display data, the second display data (111111) is outputted from the controller 3 as the next display data. In this case, all values on the data bus lines 5 is changed from 0 to 1.

To the contrary, when the data inversion signal is utilized, the controller 3 outputs (000000) onto the data bus lines 5 as the second display data. In this case, the value on the data bus lines 5 remains 0 and there is no change of the state. When the value of display data is inverted in the input latch circuit 20 in response to the data inverting signal, the second display data (111111) is outputted from the input latch circuit 20. In this manner, with the use of the data inversion signal, the display data can be transferred without substantially changing the value of the display data on the data bus lines 5.

TABLE 1

| Input | | |
|---|---|---|
| Display Data Signal | Data Inversion Signal | Output |
| 0 | 0 | 0 |
| 0 | 1 | 1 |
| 1 | 0 | 1 |
| 1 | 1 | 0 |

Subsequently, the power consumption is explained with reference to a case in which the display data is (000000) and the next display data is (111111). When the display data on the data bus lines 5 is changed from (000000) to (111111), the value of six data bus lines is changed from 0 to 1. Accordingly, it is necessary to charge all six data bus lines at high level. To the contrary, when the output of the input latch circuit 20 is set to (111111) using the data inversion signal while maintaining the display data of the data bus lines at (000000), the display data on the data bus lines 5 is not changed and hence, charging/discharging of the data bus lines 5 are not performed. Accordingly, the power which is necessary for charging and discharging the data bus line 5 can be reduced. However, in this case, since the value of six inner data bus lines 21 is changed from (000000) to (111111), charging/discharging of the inner data bus line 21 is not taken into consideration.

As another example, a case in which the display data is (010101) and the next display data is (111000) is explained. In this case, the number of data bus lines 5 which changes the state thereof becomes 4 and hence, the number of data bus lines 5 which change the state thereof is larger than the number of data bus lines 5 which do not change the state thereof. Accordingly, in this case, the controller 3 outputs (000111) to the data bus lines 5 and outputs (111000) from the input latch circuit 20 using the data inversion signal. On the data bus lines 5, the display data is changed from (010101) to (000111) and hence, the number of data bus lines 5 which change the state thereof becomes 2. The number of data bus lines 5 which change the state thereof is halved from 4 to 2 so that the low power consumption can be realized.

As described in the above-mentioned example, when the number of wiring which change the state thereof on the data bus lines 5 is equal to or more than half of the total data bus lines, the power consumption can be reduced more by making the controller 3 output signals which invert respective bit values of the display data to the data bus lines 5 and by outputting signals inputted to the input latch circuit 20 from the data bus lines 5 after inverting the signals with the data inversion signal.

On the other hand, when the number of wiring which change the state thereof on the data bus lines 5 is less than half of the total data bus lines, the controller 3 outputs the display data to the data bus lines 5 and the input latch circuit 20 also outputs signals inputted from the data bus lines 5.

Figure 3:
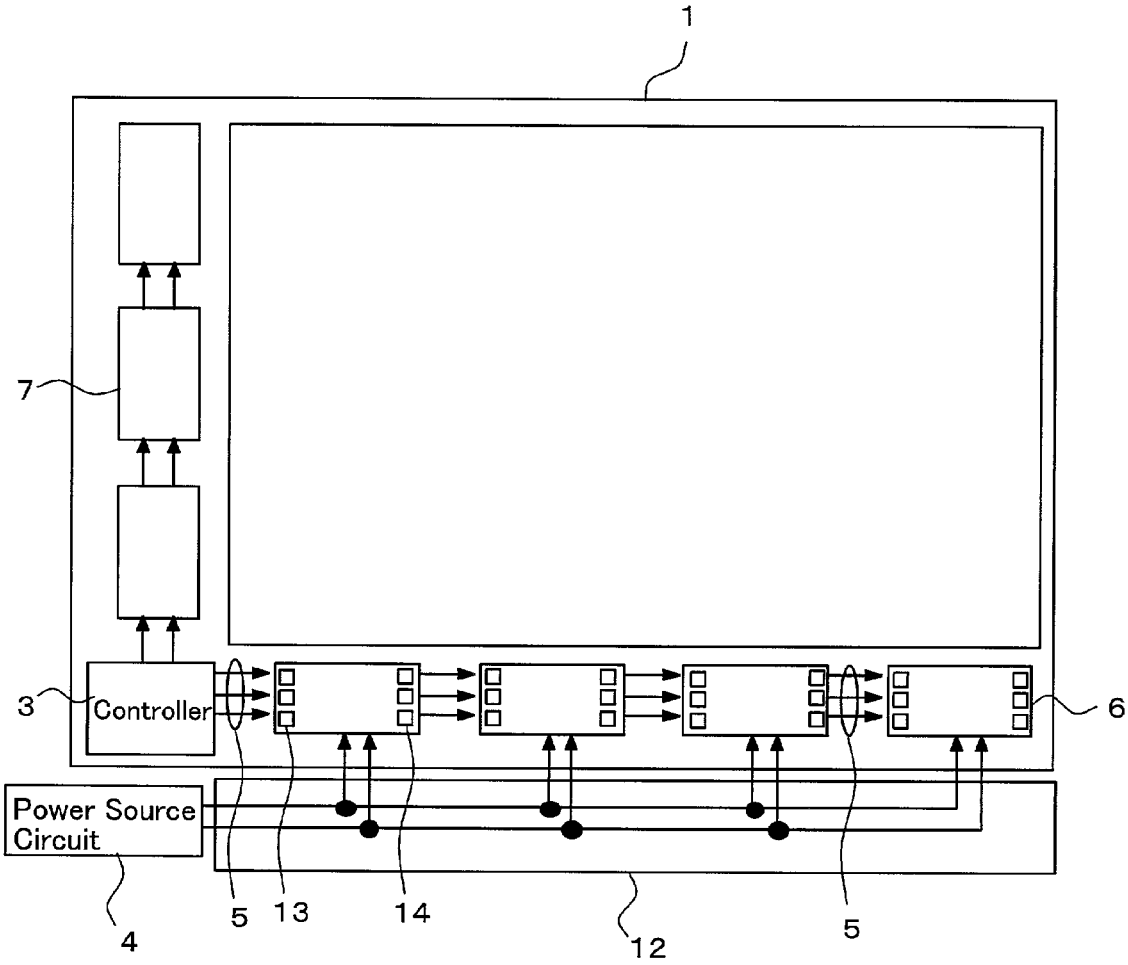
FIG. 3 is a block diagram showing a schematic constitution of the liquid crystal display according to the embodiment of the present invention.

Then, in FIG. 3, a schematic block diagram which describes a case in which the display data is transferred using wiring in the inside of source drivers 6 is shown. First of all, data bus lines 5 are extended from a controller 3 to the source drivers 6 as wiring. The source drivers 6 have input terminals 13 and the input terminals 13 are connected to the data bus lines 5. The display data is inputted to the source drivers 6 from the input terminals 13. The data bus lines 5 are also arranged between the neighboring source drivers 6 as wiring. The source driver 6 is provided with output terminals 14 and the output terminals 14 are connected with the data bus lines 5 so as to output the display data to the next-stage source driver 6. The wiring is disposed in the inside of the source driver 6 arranged between the input terminals 13 and the output terminals 14 such that the display data is transferred through the wiring in the inside of the source driver 6.

A positive gray-scale voltage and a negative gray-scale voltage outputted from a power source circuit 4 are supplied to a flexible printed circuit board 12. Here, although not shown in the drawing, various types of clock signals, an alternation driving signal and a data inversion signal are transferred through the wiring in the inside of the source driver 6 in the same manner as the display data.

Figure 4:
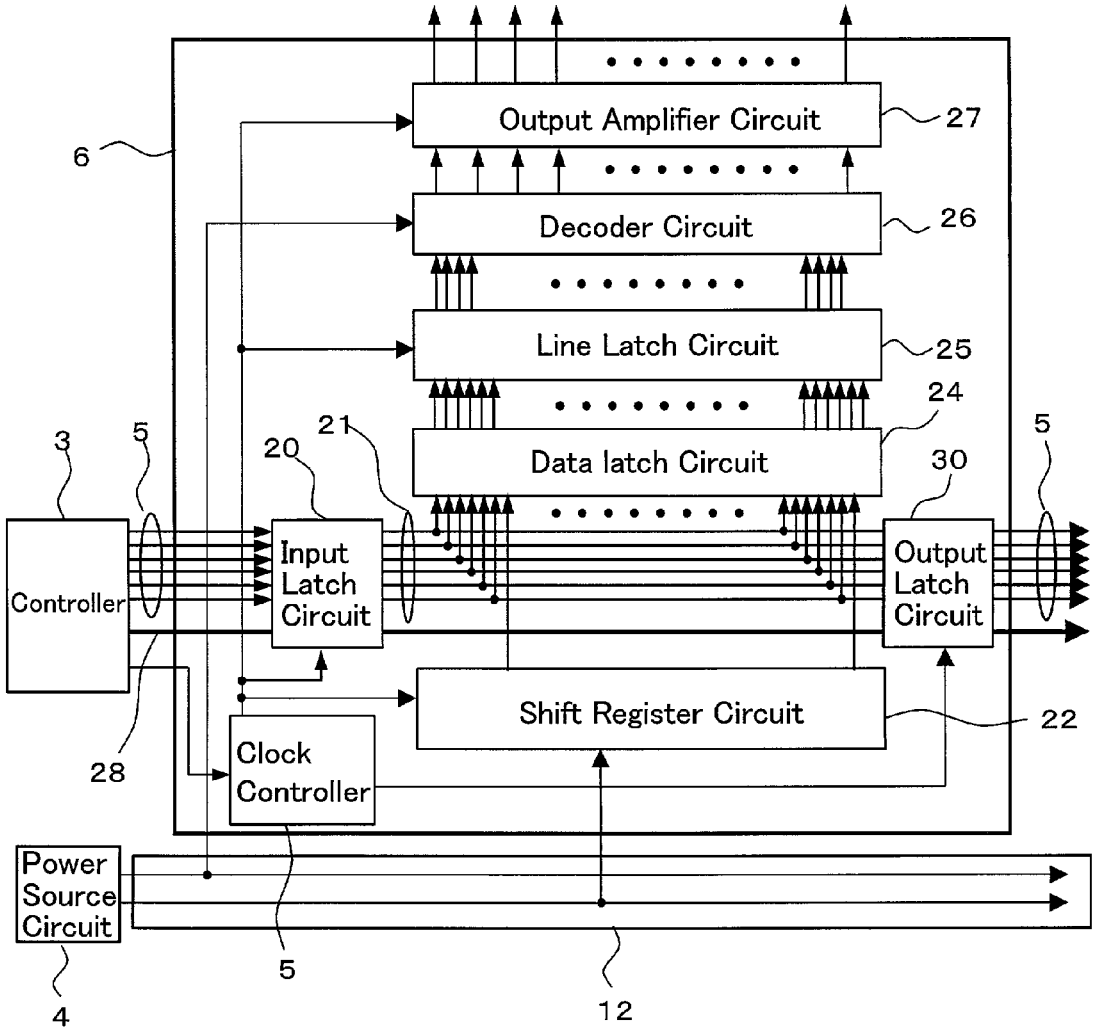
FIG. 4 is a schematic block diagram showing the source driver of the liquid crystal display according to the embodiment of the present invention.

FIG. 4 shows a schematic block diagram of the source driver 6 which can cope with a method in which display data is transferred using wiring in the inside of the source driver 6. Data bus lines 5 are connected to an input latch circuit 20 and the display data is inputted to the input latch circuit 20. In the input latch circuit 20, the display data and a clock signal outputted from a clock controller 23 are synchronized. Further, in the input latch circuit 20, an inversion calculation is performed between the display data and a data inversion signal to reduce the power consumption.

Inner data bus lines 21 are connected to the input latch circuit 20 such that the display data is outputted to the inner data bus lines 21 from the input latch circuit 20. The inner data bus lines 21 are connected to a data latch circuit 24 so that the display data is transferred to the data latch circuit 24. Further, the inner data bus lines 21 are connected to an output latch circuit 30 arranged in the inside of the source driver 6. Further, the display data outputted from the output latch circuit 30 is transferred to the next-stage source driver 6. However, as mentioned previously, since the calculation is performed between the display data and the data inversion signal in the input latch circuit 20, an inverse calculation is performed between the display data outputted from output terminals and the data inversion signal so as to return the display data to the original state and the display data is transferred to the next-stage source driver 6.

In the circuit shown in FIG. 4, the data bus lines which can enjoy the reduction of power consumption using the data inversion signal are limited to the data bus lines 5 outside the source driver 6 and the reduction of the power consumption of the inner data bus lines 21 is not taken into consideration. However, in forming the data bus lines 5 on a liquid crystal display panel 1, it is often the case that conductors having high resistance value such as chromium are used as wiring. Accordingly, when the wiring load of the data bus lines 5 is high compared to the wiring load on the inner data bus lines 21, the reduction of the power consumption at the data bus lines 5 between the source drivers using the data inversion signal is effective to achieve the low power consumption.

Figure 5:
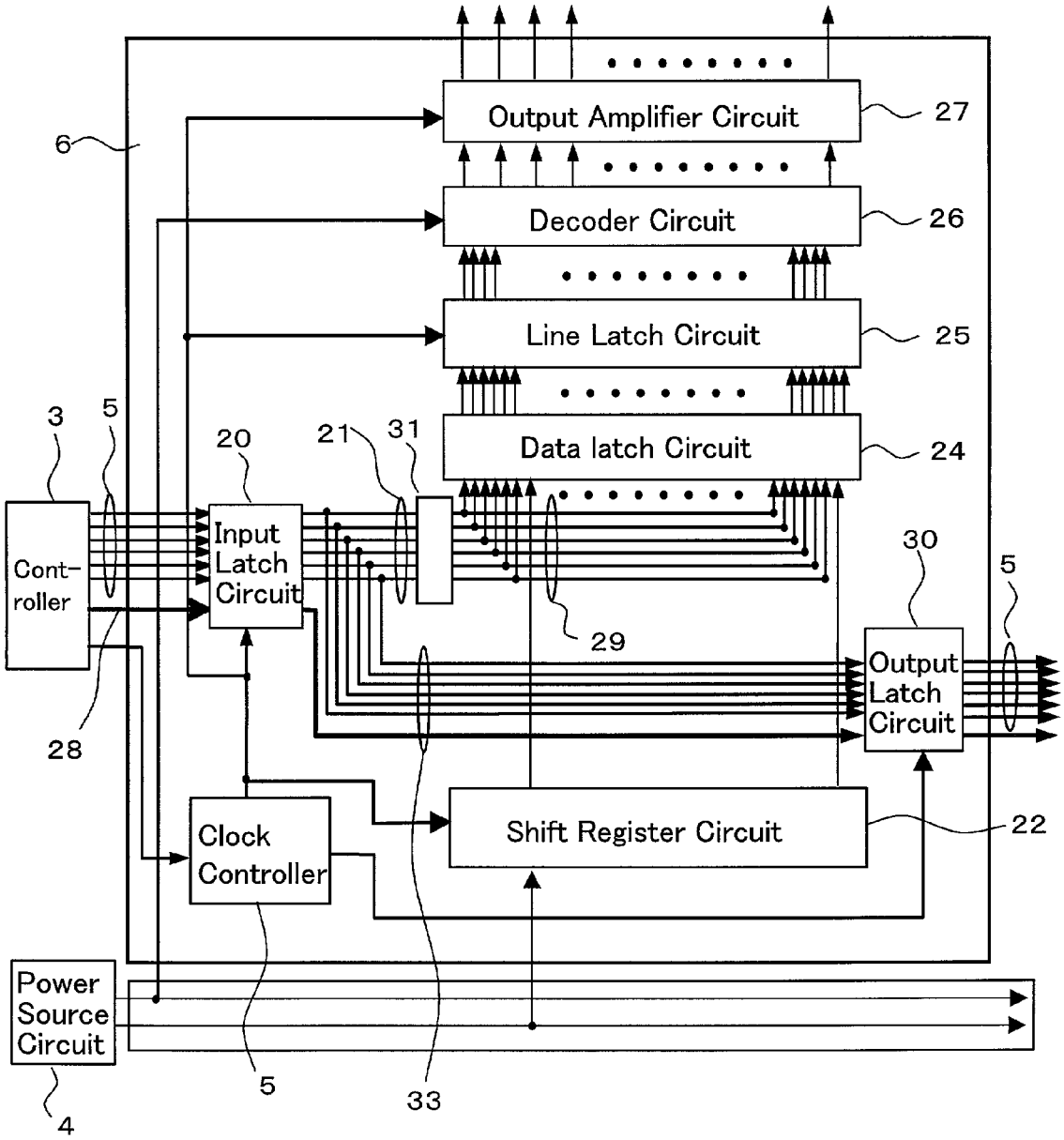
FIG. 5 is a schematic block diagram showing the source driver of the liquid crystal display according to the embodiment of the present invention.

FIG. 5 shows a schematic block diagram of a source driver 6 provided with transfer data bus lines 33. The transfer data bus lines 33 are arranged parallel to inner data bus lines 21 from an input latch circuit 20 as wiring. The inner data bus lines 21 are connected to a data latch circuit 24 so as to transfer display data to the data latch circuit 24. The transfer data bus lines 33 are arranged in the inside of the source driver 6 as wiring and are connected to an output latch circuit 30 so as to transfer the display data to a next-stage source driver 6. Calculation is performed between a data inversion signal and the display data in the input latch circuit 20, while an inverse calculation is performed between the data inversion signal and the display data in the output latch circuit 30.

The inner data bus lines 21 are provided with a standby circuit 31. The standby circuit 31 prevents the change of the value of the inner data bus lines 21 when the data latch circuit 24 does not fetch the display data from the inner data bus line 21. With the provision of the standby circuit 31, among a plurality of source drivers 6, the source driver 6 which generates charging/discharging of the inner data bus lines 21 is constituted of only one source driver in which the display data is fetched in the data latch circuit 24 so that the low power consumption can be achieved.

Further, since the inner data bus lines 21 are connected to the data latch circuit 24, the inner data bus lines 21 exhibit a large wiring load compared to that of the transfer data bus lines 33. In the circuit shown in FIG. 5, the transfer of the display data to the next-stage source driver 6 is performed using the transfer data bus lines 33 having a low wiring load so that low power consumption can be achieved.

Figure 6:
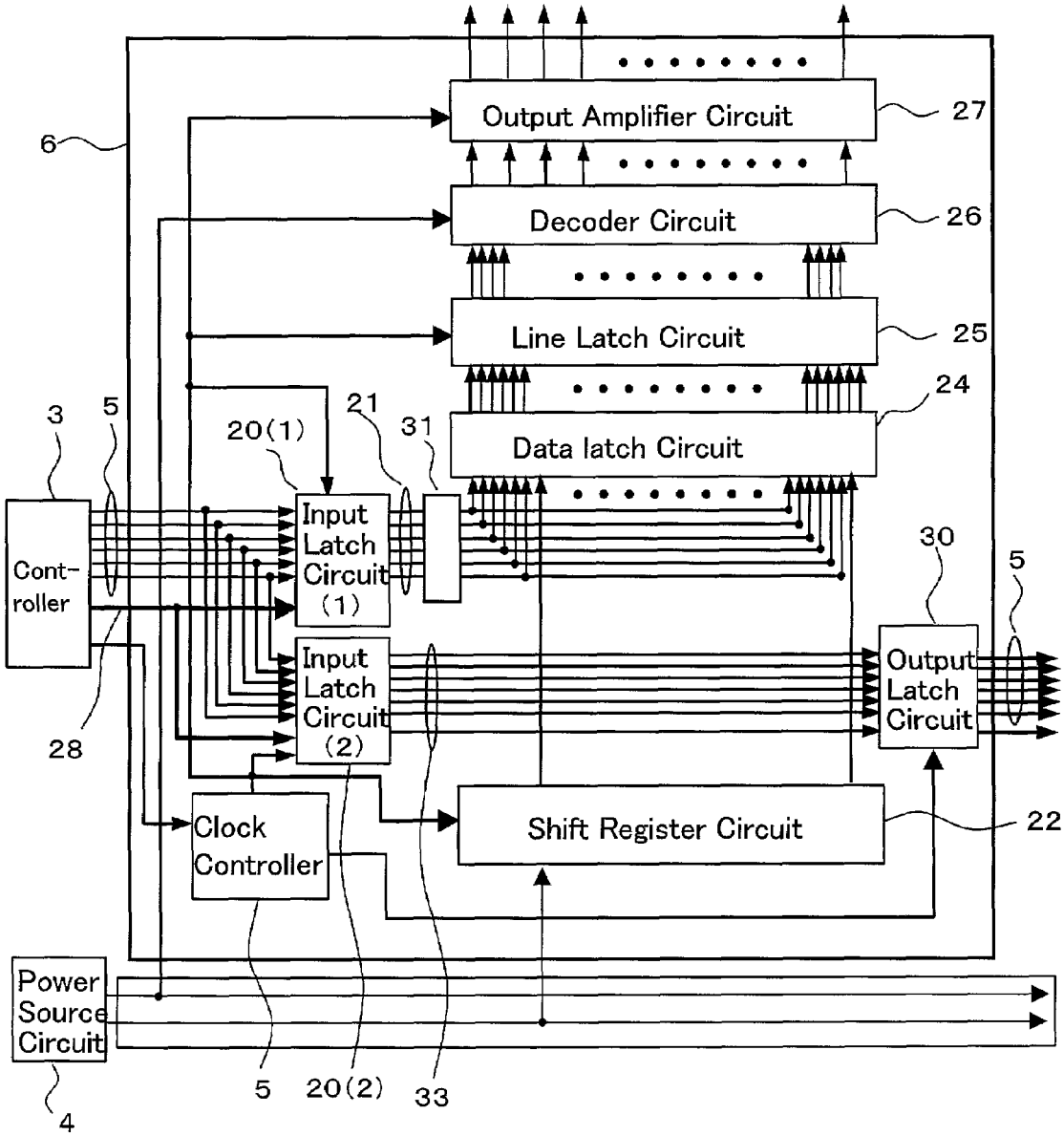
FIG. 6 is a schematic block diagram showing the source driver of the liquid crystal display according to the embodiment of the present invention.

Then, FIG. 6 shows a schematic block diagram of a source driver 6 which separates data bus lines arranged before an input latch circuit 20. In the input latch circuit 20 (1), calculation is performed between a data inversion signal and display data. On the other hand, in the input latch circuit 20 (2), the calculation between the data inversion signal and the display data is not performed. Accordingly, the display data transferred by transfer data bus lines 33 is not calculated using the data inversion signal so that the low power consumption at the transfer data bus lines 33 can be achieved. Further, it is unnecessary to perform an inverse calculation in an output latch circuit 30. Since the display data and the data inversion signal have their phases match with each other in the output latch circuit 30, the display data and the data inversion signal can be synchronized using a clock signal.

The circuit shown in FIG. 6 is also provided with a standby circuit 31 in the inner data bus lines 21. With the provision of the standby circuit 31, charging/discharging in the inner data bus lines 21 can be reduced thus achieving the lower power consumption.

Figure 7:
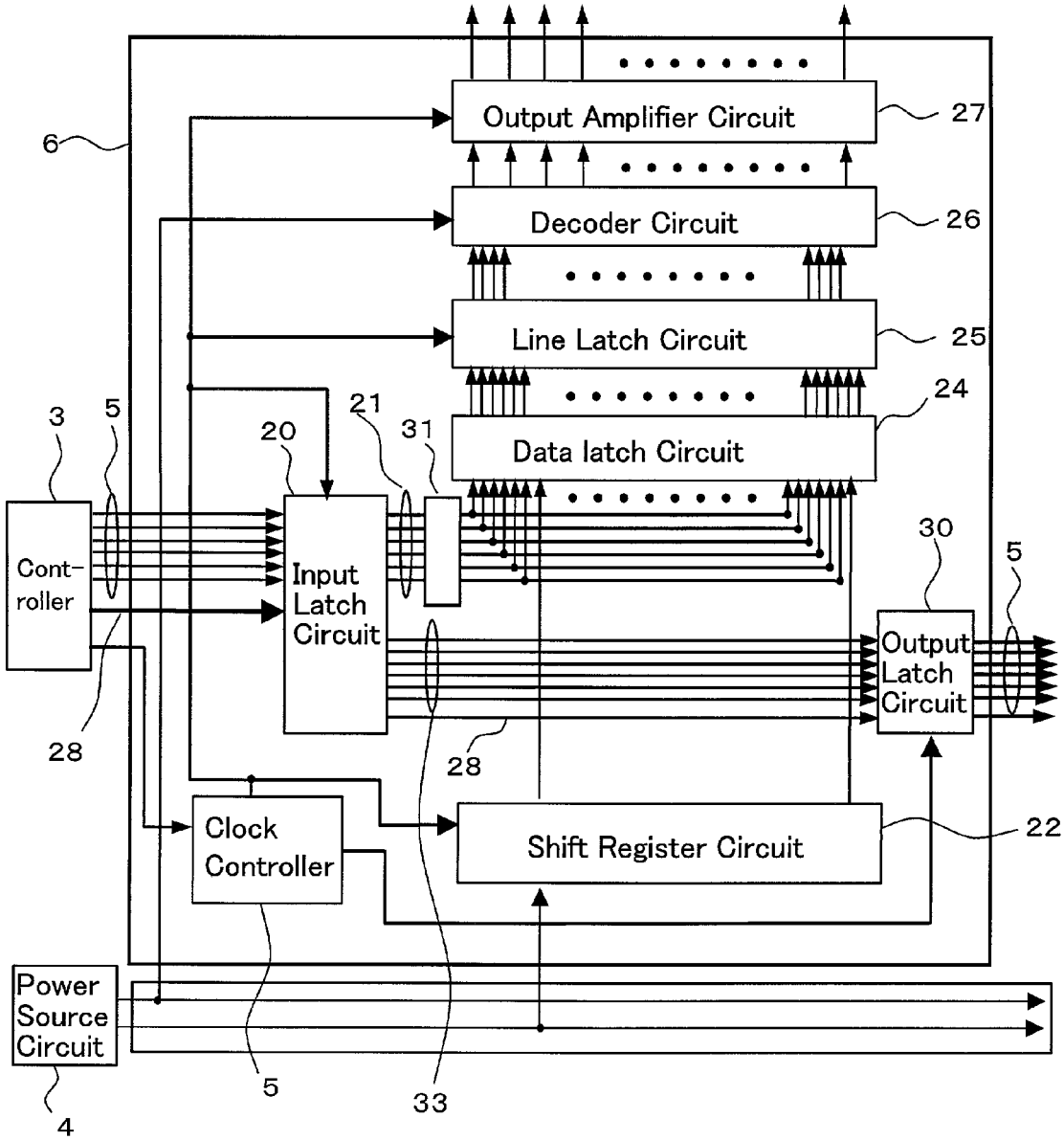
FIG. 7 is a schematic block diagram showing the source driver of the liquid crystal display according to the embodiment of the present invention.

Subsequently, FIG. 7 shows a schematic block diagram of a source driver 6 which connects data bus lines 5 to an input latch circuit 20 and connects the input latch circuit 20 to the inner data bus lines 21 and transfer data bus lines 33. Display data which is subjected to calculation between the display data and a data inversion signal is outputted to the inner data bus lines 21 connected to the input latch circuit 20. On the other hand, the display data which is not subjected to calculation between the display data and the data inversion signal is outputted to the transfer data bus lines 28. Accordingly, the display data transferred through the transfer data bus lines 33 is not calculated using the data inversion signal so that the low power consumption can be achieved with respect to the transfer data bus lines 33. Further, it is unnecessary to perform the inverse calculation in an output latch circuit 30. Since the display data and the data inversion signal have their phases matched with each other in the output latch circuit 30, the display data and the data inversion signal are synchronized using the clock signal.

The circuit shown in FIG. 7 is also provided with a standby circuit 31 in the inner data bus lines 21. With the provision of the standby circuit 31, charging/discharging in the inside of the inner data bus line 21 can be reduced so that the lower power consumption can be achieved.

Figure 8:
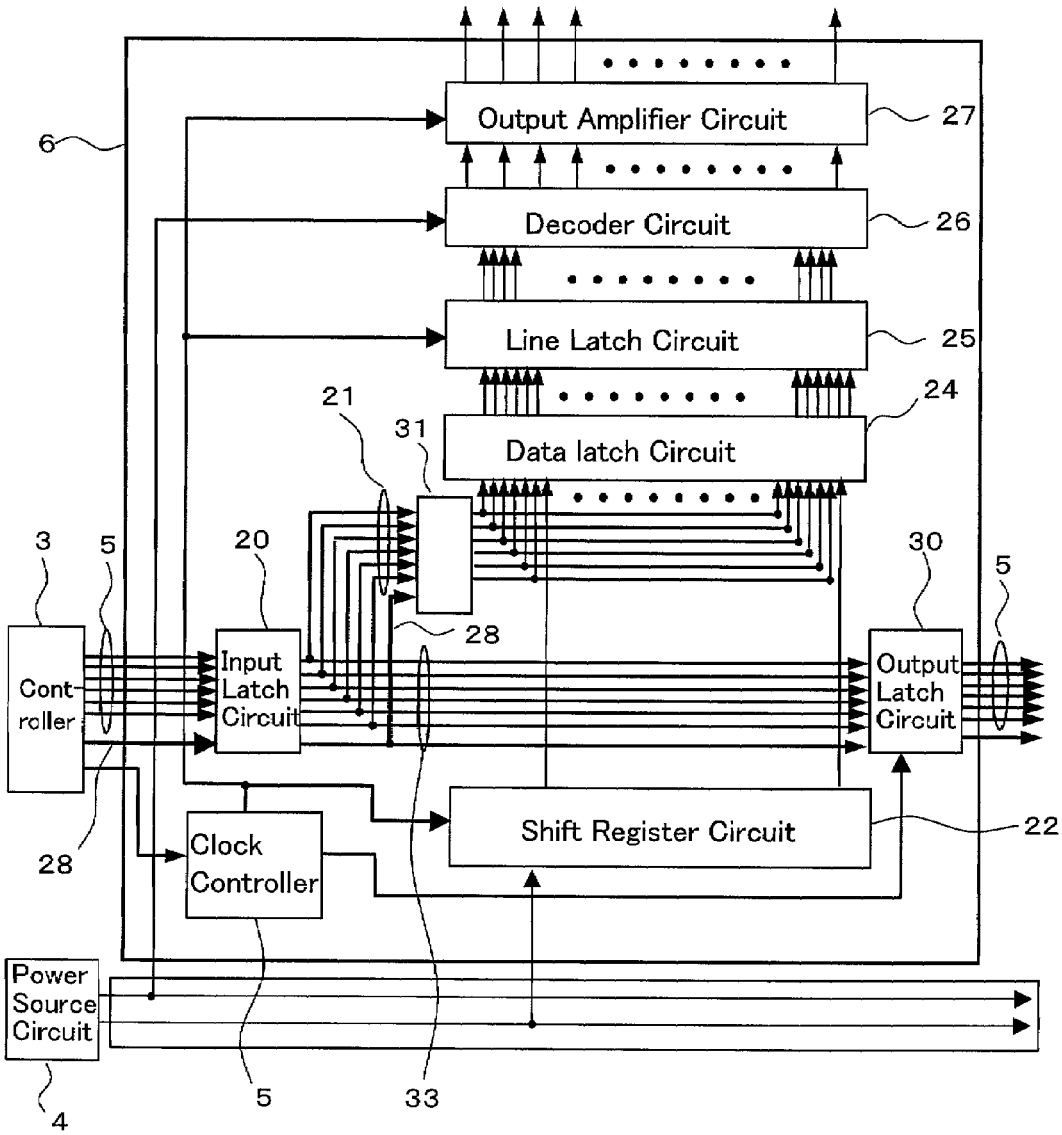
FIG. 8 is a schematic block diagram showing the source driver of the liquid crystal display according to the embodiment of the present invention.

Then, FIG. 8 shows a schematic block diagram of a source driver 6 which performs a data inversion calculation between an input latch circuit 20 and a data latch circuit 24. Here, the data inversion calculation is not performed in the input latch circuit 20 but is performed prior to inputting of display data to the data latch circuit 24. In the circuit shown in FIG. 8, the data inversion calculation is performed in a standby circuit 31. Since the data inversion calculation is not performed in transfer data bus lines 33 in the circuit shown in FIG. 8, the change of state of the transfer data bus lines 33 can be reduced. Further, it is also unnecessary to perform an inverse calculation in an output latch circuit 30.

Figure 9:
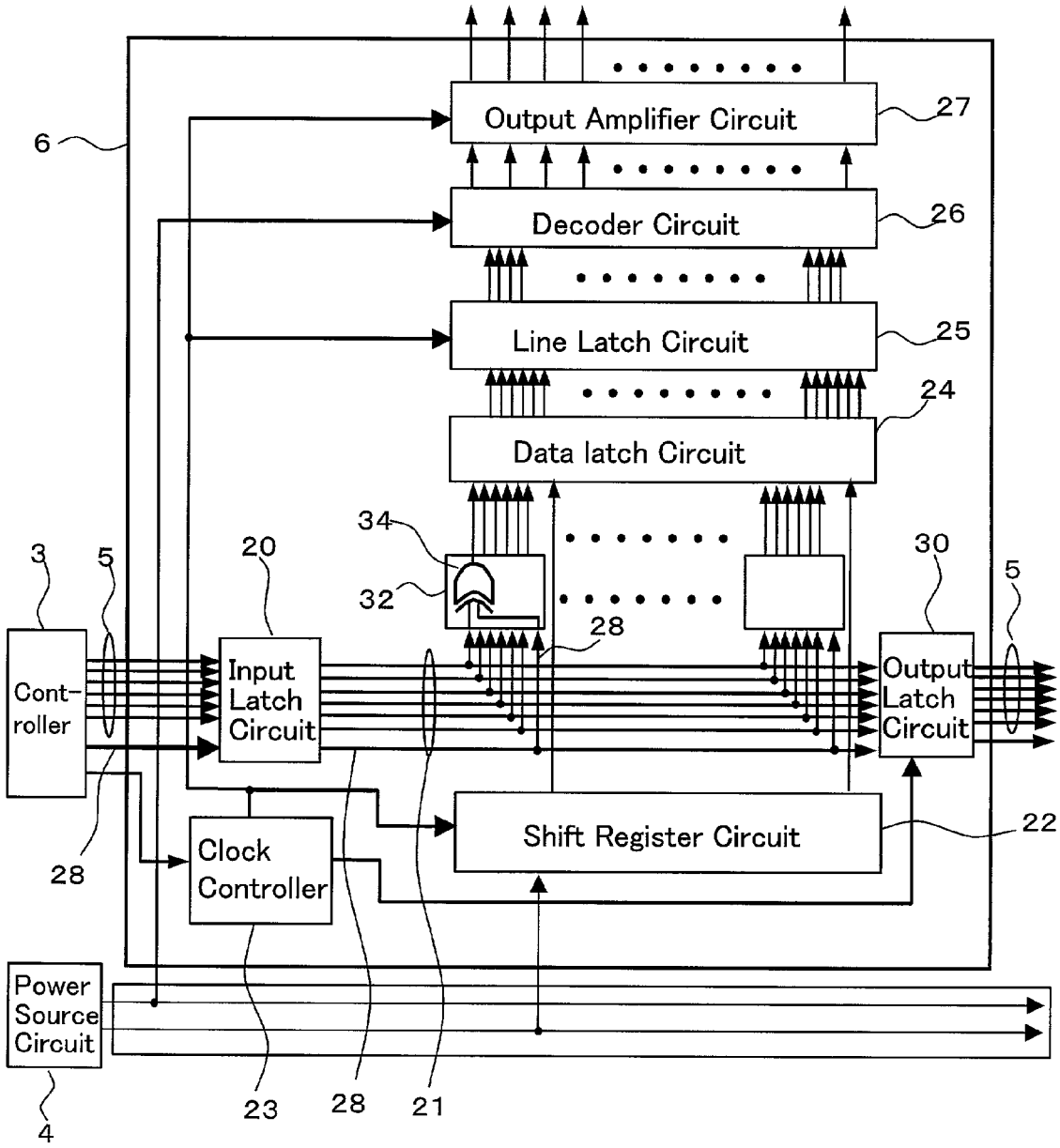
FIG. 9 is a schematic block diagram showing the source driver of the liquid crystal display according to the embodiment of the present invention.

Then, FIG. 9 shows a schematic block diagram of a source driver 6 which also performs a data inversion calculation between an input latch circuit 20 and a data latch circuit 24. The data inversion calculation is not performed in the input latch circuit but is performed prior to inputting of display data to a data latch circuit 24. As shown in FIG. 9, a data inversion calculation circuit 32 is disposed between inner data bus lines 21 and the data latch circuit 24 and the data inversion calculation is performed in the data inversion calculation circuit 32. Since the data inversion calculation is performed based on the exclusive OR as mentioned previously, it is possible to use a conventional exclusive-OR circuit as the data inversion calculation circuit 32. In FIG. 9, to clarify the constitution in the drawing, the exclusive-OR circuit 34 is depicted with respect to display data for only one data bus line.

In the circuit shown in FIG. 9, the inner data bus lines 21 are separated and hence, it is unnecessary to provide transfer data bus lines 33. Accordingly, the increase of the number of data bus lines can be suppressed thus realizing the low power consumption. Further, the inner data bus lines 21 which comes after the input latch circuit 20 are not subjected to the data inversion calculation, and hence, the change of state of the inner data bus lines 21 can be reduced. Further, since the load of wiring which comes after the data inversion calculation circuit 32 is small compared to that of the data bus lines, the power consumption brought about by charging/discharging can be minimized.

Figure 10:
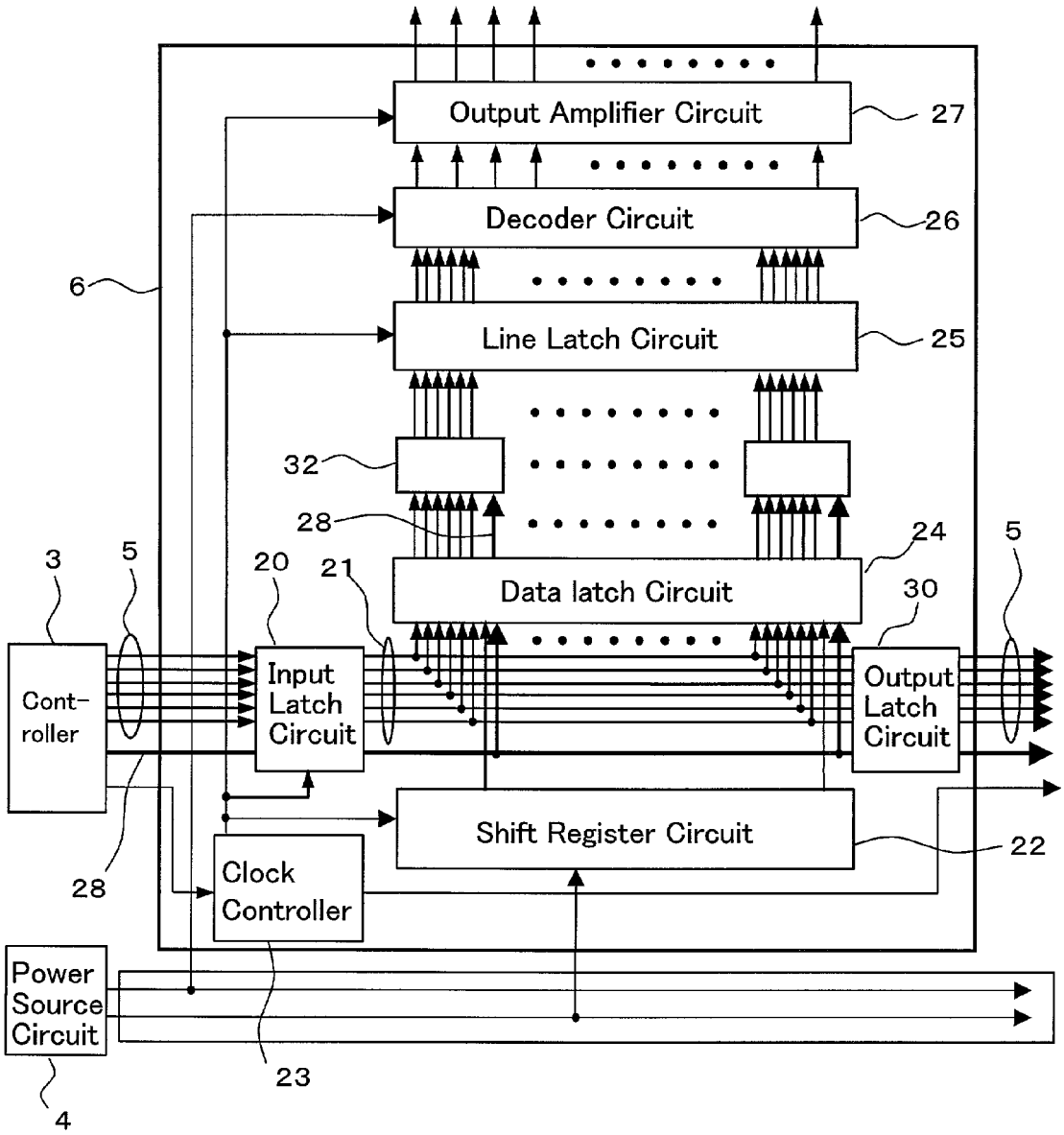
FIG. 10 is a schematic block diagram showing the source driver of the liquid crystal display according to the embodiment of the present invention.

Then, FIG. 10 shows a schematic block diagram of a source driver 6 in which a data inversion signal is inputted to a data latch circuit 24. By inputting the data inversion signal to the data latch circuit 24, it is possible to perform the calculation using the data inversion signal which comes after the data latch circuit 24.

In the circuit shown in FIG. 10, the calculation between the display data signal and the data inversion signal is not performed in an input latch circuit 20. That is, in the input latch circuit 20, the display data signal and the clock signal are only synchronized and display data which is inputted to inner data bus lines 21 is outputted without being subjected to the inversion calculation. The inner data bus lines 21 are bifurcated or branched for transmitting data to a data latch circuit 24. Further, the inner data bus lines 21 are arranged in the inside of the source driver 6 as wiring and are connected to an output latch circuit 30. In the output latch circuit 30, the display data is synchronized with a clock signal and is transferred to a next-stage source driver 6. On the other hand, the data inversion signal is also inputted to the data latch circuit 24 in the same manner as the display data. The calculation of the display data signal and the data inversion signal is performed after outputting the display data signal and the data inversion signal from the data latch circuit 24. The display data and the data inversion signal are outputted from the data latch circuit 24 and are inputted to a data inversion calculation circuit 32 where the data inversion calculation is performed. Further, the display data which has been subjected to the data inversion calculation is inputted to a line latch circuit 25.

In the circuit shown in FIG. 10, since the inner data bus lines 21 are separated, it is unnecessary to provide transfer data bus lines 33. Further, since the inner data bus lines 21 which comes after the input latch circuit 20 are not subjected to the data inversion calculation, the change of state of the inner data bus lines 21 can be reduced. Accordingly, along with the low power consumption brought about by suppressing the increase of the number of data bus lines, the power consumption caused by the change of state of the inner data bus lines 21 can be reduced.

Here, although the change of state cannot be suppressed with respect to the wiring which follows the data inversion calculation circuit 32, since the load of wiring which comes after the data inversion calculation circuit 32 is small compared to the data bus lines, it is possible to minimize the power consumption caused by charging/discharging. Further, in the circuits, as shown in FIG. 9 and FIG. 10, the inner data bus lines 21 also play a role of the transfer data bus lines which transfer the display data to the next-stage source driver 6 and hence, the inner data bus lines 21 cannot be provided with a standby circuit. Accordingly, the circuits shown in FIG. 9 and FIG. 10 are particularly effective in cases that the low power consumption cannot be achieved by the standby circuit.

Further, in this method, although the output latch circuit 30 is provided and the display data signal and the data inversion signal are synchronized using the clock signal, it is possible to perform the similar synchronization using an input latch circuit of the next-stage driver without using the output latch circuit 30.

Figure 11:
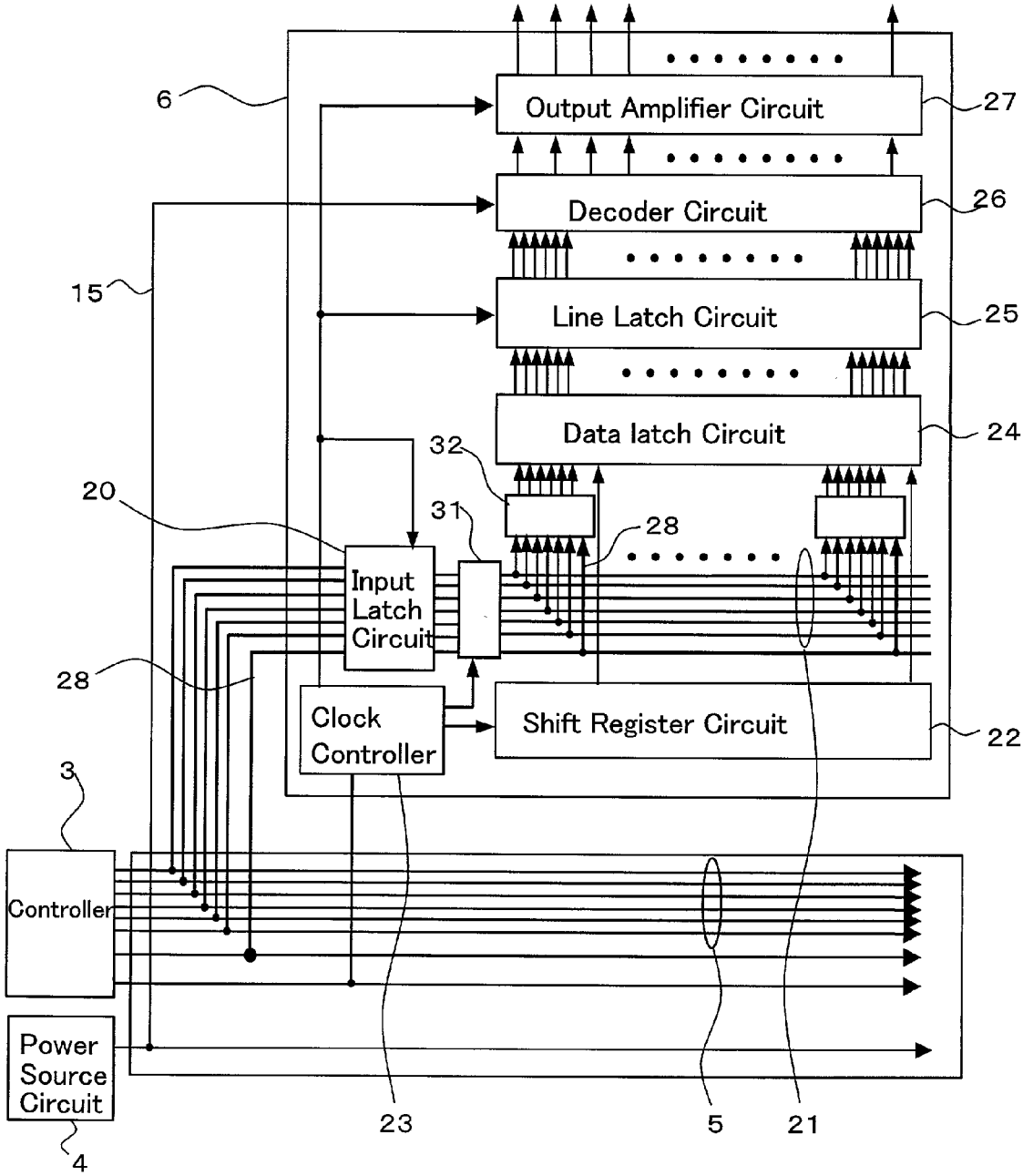
FIG. 11 is a schematic block diagram showing the source driver of the liquid crystal display according to the embodiment of the present invention.

Subsequently, FIG. 11 shows a schematic block diagram of a source driver 6 which performs a data inversion calculation between inner data bus lines 21 and a data latch circuit 24 in a liquid crystal display in which data bus lines 5 are formed outside the source driver 6. In the circuit shown in FIG. 11, the data inversion calculation is not performed in an input latch circuit 20 but is performed prior to inputting of display data to a data latch circuit 24.

In the circuit shown in FIG. 11, since the data inversion calculation is performed at the wiring separated from the inner data bus lines 21, the change of state of the inner data bus lines 21 can be reduced. Further, the load of wiring which comes after the data latch circuit 24 is small compared to that of the inner data bus lines 21 and hence, it is possible to minimize the power consumption caused by charging/discharging. Further, a standby circuit 31 is provided to the inner data bus line 21. Accordingly, in response to a control signal from a clock controller 23 or the like, it is possible to achieve the low power consumption by preventing the change of the value of the inner data bus lines 21 when the source driver 6 does not fetch display data.

Figure 12:
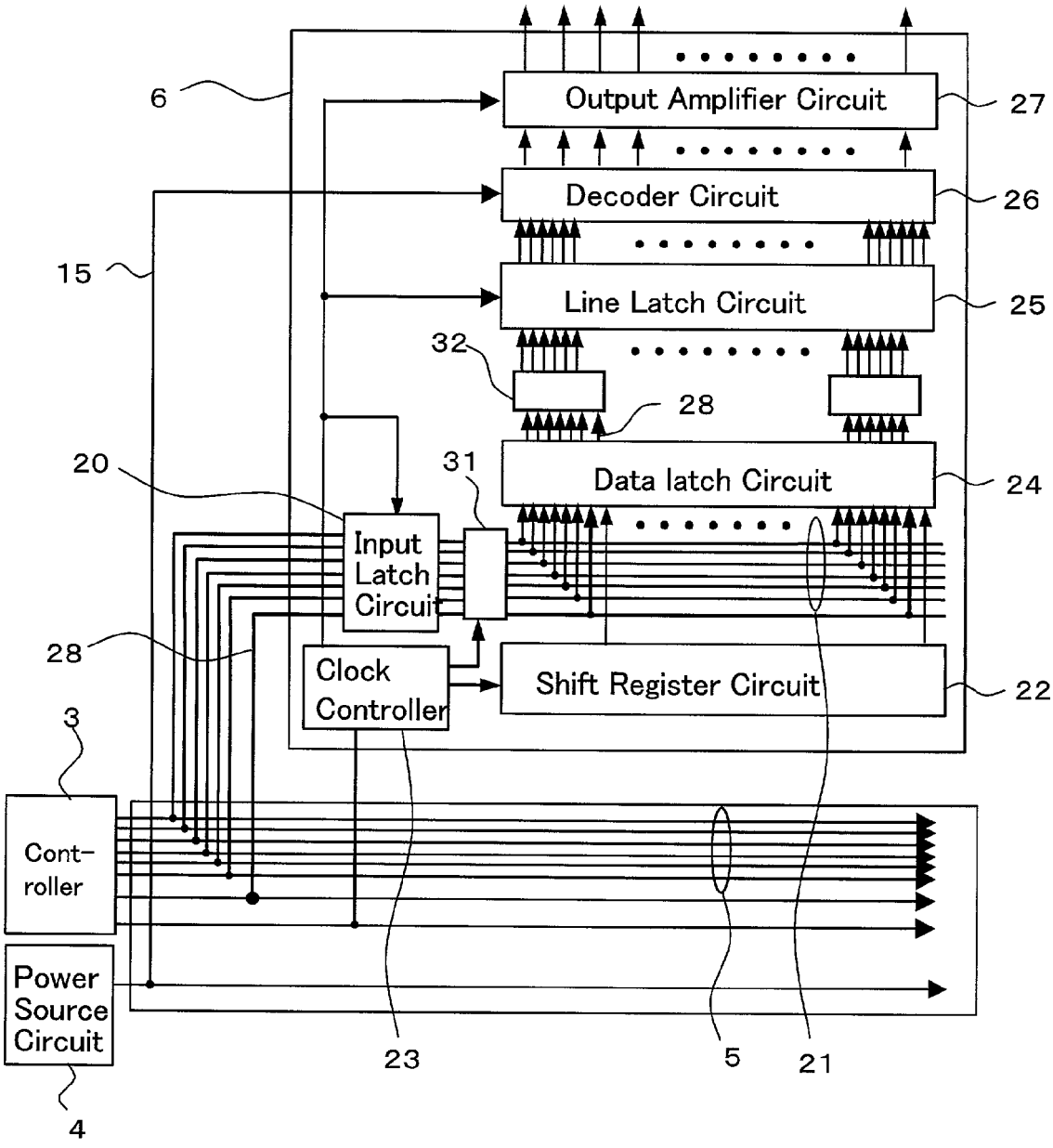
FIG. 12 is a schematic block diagram showing the source driver of the liquid crystal display according to the embodiment of the present invention.

Subsequently, FIG. 12 shows a schematic block diagram of a source driver 6 which performs a data inversion calculation after a data latch circuit 24 in a liquid crystal display in which data bus lines 5 are provided outside the source driver 6. In the circuit shown in FIG. 12, the data inversion calculation is not performed in an input latch circuit 20 but is performed prior to inputting of display data to a line latch circuit 25.

In the circuit shown in FIG. 12, since the data inversion calculation is performed on the wiring which comes after the data latch circuit 24, the change of state of the inner data bus lines 21 can be reduced. Further, since the load of wiring which comes after the data latch circuit 24 is small compared to the inner data bus lines 21, the power consumption caused by charging/discharging can be minimized. Further, a standby circuit 31 is provided to the inner data bus line 21. Accordingly, in response to a control signal from a clock controller 23 or the like, it is possible to achieve the low power consumption by preventing the change of the value of the inner data bus lines when the source driver 6 does not fetch the display data.

With the addition of the circuit having the standby function, by stopping the function of the drivers other than the source drivers which are assumed to fetch data, the change of state of the data bus lines in the inside of the drivers can be reduced thus realizing the low power consumption.

The inner data bus lines and the transfer data bus lines are separated prior to the data inversion calculation in the input latch circuit so that the power consumption caused by the data transfer to the next-stage source driver can be reduced by the data inversion calculation function.

Although the data bus line in the inside of the source driver are used in common for the inner circuit and for the transfer of display data to the next-stage source driver, the data inversion calculation is not performed in the input latch circuit and the data inversion calculation between the data signal and the data inversion signal is performed prior to the data latch circuit or the line latch circuit disposed in the inside of the source driver so that the data inversion function is effectively performed without increasing the number of data bus lines whereby the power consumption brought about by the data bus lines can be reduced.

What is claimed is:

1. A liquid crystal display comprising a liquid crystal display panel and a plurality of driving circuits for driving the liquid crystal display panel, the driving circuits comprising:

an input circuit to which digital display data is inputted from outside, a data latch circuit which holds the digital display data, a decoder circuit which selects a gray scale voltage in accordance with the digital display data which is held by the data latch circuit, an output amplifier which outputs the gray scale voltage to the liquid crystal display panel, an output circuit which outputs the digital display data to next-stage driving circuits, data transfer wiring which connects between the input circuit and the output circuit, and a data inversion calculation circuit that inverts the digital display data in accordance with a data inversion signal, wherein the data inversion calculation circuit electrically connects with the output of the data latch circuit, an inversion signal line outputs signals from the data latch circuit and connects to the data inversion calculation circuit, the data inversion calculation circuit includes an exclusive OR circuit, and the digital display data and the data inversion signal input into the exclusive OR circuit.

2. A liquid crystal display comprising a liquid crystal display panel and a plurality of driving circuits for driving the liquid crystal display panel, the driving circuits comprising:

an input terminal portion to which digital display data is inputted from outside, a data latch circuit which holds the digital display data, a decoder circuit which selects a gray scale voltage in accordance with the digital display data which is held by the data latch circuit, an output amplifier which outputs the gray scale voltage to the liquid crystal display panel, an output terminal portion which outputs the digital display data to next-stage driving circuits, data transfer wiring which connects between the input terminal portion and the output terminal portion, wherein a data inversion calculation circuit is formed between the data latch circuit and the decoder circuit, a inversion signal line is connected to the data inversion calculation circuit, an output data of the data latch circuit is inverted by the data inversion calculation circuit, the data inversion calculation circuit includes an exclusive OR circuit, and the digital display data and the data inversion signal input into the exclusive OR circuit.

3. A liquid crystal display comprising a liquid crystal display panel and a plurality of driving circuits for driving the liquid crystal display panel, the driving circuits comprising:

an input circuit to which digital display data is inputted from outside, a data latch circuit which holds the digital display data, a decoder circuit which selects a gray scale voltage in accordance with the digital display data which is held by the data latch circuit, an output amplifier which outputs the gray scale voltage to the liquid crystal display panel, an output circuit which outputs the digital display data to next-stage driving circuits, and data transfer wiring which connects between the input circuit and the output circuit, wherein a data inversion calculation circuit is provided between the data latch circuit and the output amplifier, and a value of the digital display data is inverted by the data inversion calculation circuit, the data inversion calculation circuit includes an exclusive OR circuit, and the digital display data and the data inversion signal input into the exclusive OR circuit.

* * * * *